US010858214B2

(12) United States Patent
D'Entremont

(10) Patent No.: US 10,858,214 B2
(45) Date of Patent: Dec. 8, 2020

(54) SEQUETIAL COILING OF A ROPE BY SEGMENTS

(71) Applicant: Christian D'Entremont, Yarmouth (CA)

(72) Inventor: Christian D'Entremont, Yarmouth (CA)

( * ) Notice: Subject to any disclaimer, the term of this patent is extended or adjusted under 35 U.S.C. 154(b) by 28 days.

(21) Appl. No.: 16/501,512

(22) Filed: Apr. 23, 2019

(65) Prior Publication Data

US 2020/0339394 A1 Oct. 29, 2020

(51) Int. Cl.
*B65H 54/82* (2006.01)

(52) U.S. Cl.
CPC ..... *B65H 54/82* (2013.01); *B65H 2701/35* (2013.01); *B65H 2701/355* (2013.01)

(58) Field of Classification Search
CPC ..... B65H 54/56; B65H 54/58; B65H 54/80; B65H 54/82; B65H 2701/35; B65H 2701/355
See application file for complete search history.

(56) References Cited

U.S. PATENT DOCUMENTS

| | | | |
|---|---|---|---|
| 2,357,065 | A | 8/1944 | Zaica |
| 2,849,195 | A | 8/1958 | Richardson et al. |
| 2,929,179 | A | 3/1960 | George |
| 2,936,509 | A | 5/1960 | Martin |
| 2,943,810 | A | 7/1960 | Seavey |
| 2,944,755 | A | 7/1960 | Foster |
| 2,957,640 | A | 10/1960 | Lewis, Jr. |
| 3,054,570 | A | 9/1962 | Nye |
| 3,088,690 | A | 5/1963 | Haugwitz |
| RE25,477 | E | 11/1963 | Crum |
| 3,113,745 | A | 12/1963 | Bittman |
| 3,147,934 | A | 9/1964 | Godderidge |
| 3,266,694 | A | 8/1966 | Morris |
| 3,327,368 | A | 6/1967 | Russo et al. |
| 3,337,154 | A | 8/1967 | Smith, Jr. et al. |
| 3,423,043 | A | 1/1969 | Kane et al. |
| 3,563,488 | A | 2/1971 | Bollig |
| 3,737,112 | A | 6/1973 | Tellerman et al. |
| 3,750,970 | A | 8/1973 | Tremoulet, Jr. |
| 3,765,614 | A | 10/1973 | Bartl et al. |
| 3,903,632 | A | 9/1975 | Tison et al. |
| 4,026,483 | A | 5/1977 | Skalleberg |
| 4,165,830 | A | 8/1979 | Svendsen |
| 4,293,103 | A | 10/1981 | Tsukamoto |
| 4,304,366 | A | 12/1981 | Enneking et al. |
| D263,371 | S | 3/1982 | Allen |

(Continued)

*Primary Examiner* — William E Dondero
(74) *Attorney, Agent, or Firm* — Mario Theriault

(57) ABSTRACT

A method for sequentially coiling a rope by segments, comprising the steps of attaching a first grab in a rope to the lower rim of a cylindrical mandrel; rotating the mandrel about a vertical axis and forming a plurality of coils including a last coil on the mandrel; stopping a rotation of the mandrel; releasing the first grab and the plurality of coils from the mandrel into a basket rotating under the mandrel. While releasing the first grab, holding a second or subsequent grab along a tail end of the last coil on the mandrel, and repeating the above steps of attaching; rotating; forming; stopping; releasing; holding and repeating, with the second or subsequent grab, until an entire length of the rope has been coiled in the basket. In another aspect, a step of working the rope is carried out between the step of stopping and the step of releasing.

10 Claims, 3 Drawing Sheets

(56) References Cited

U.S. PATENT DOCUMENTS

| | | | |
|---|---|---|---|
| 4,593,815 | A | 6/1986 | Wright |
| D324,644 | S | 3/1992 | Jacobs |
| 7,370,823 | B2 | 5/2008 | Lammermann et al. |
| 7,690,544 | B2 | 4/2010 | Zaruba |

SEQUETIAL COILING OF A ROPE BY SEGMENTS

The present application claims the benefit of U.S. Provisional Application No. 62/762,914, filed May 25, 2018.

FIELD OF THE PRESENT INVENTION

The present invention pertains to the coiling of ropes between uses, and more particularly, it pertains to sequential coiling of a rope, one segment at the time.

BACKGROUND OF THE PRESENT INVENTION

The best examples of rope coiling are found in the marine industries. Boats use ropes on their anchors and as mooring cables. Tugboats use ropes as tow lines. In the fishing industries, ropes are used on mussel-growing installations, on shellfish trap lines and on fishing lines and nets. Between uses these ropes are neatly coiled on the ship's deck, ready for the next deployment. The coiling of ropes on a ship deck is reserved to trained sailors, as a deployment without tangle is essential in that profession.

Line coiling apparatus have been found in the prior art. For example, the following documents explain the effort of others in the coiling of ropes, especially fishing lines.

U.S. Pat. No. 3,750,970 issued to O. L. Tremoulet, Jr., on Aug. 7, 1973.

U.S. Pat. No. 3,765,614 issued to Bartl et al., on Oct. 16, 1973. The installation described in the Tremoulet and Bartl et al. documents is mounted on the deck of a fishing boat. This machine uses a line-hauler winch mounted on a davit, and a line-coiler winch mounted to the mast of the boat, above a cylindrical receptacle. The fishing line is fed from the line-coiler winch to a rotating spout mounted above the receptacle. The rope is fed by the rotating spout in horizontal coils into the receptacle.

When the line being pulled has traps attached to it, the winches are momentarily stopped to detach the traps from the rope, and then started again. Every stop and start in the feeding of the rope to the receptacle causes a disruption in the symmetry of the coiled rope inside the receptacle. Every time the feeding of the rope stops, the rope tends to lay closer to the center of the coil. While these coil disruptions may be acceptable in certain applications, it is not desirable in others, such as in a mooring rope coiled on a ship deck for example.

Other examples of line coiling machines used on the deck of boats are described in the following documents.

U.S. Pat. No. 3,903,632 issued to K. F. Tison et al., on Sep. 9, 1975;

U.S. Pat. No. 4,165,830 issued to R. A. Svendsen on Aug. 28, 1979;

U.S. Pat. No. 7,690,544 issued to T. T. Zaruba on Apr. 6, 2010.

The coiling of rope-like material, however, is not limited to the fishing industry. The following documents provide a good inventory of systems for coiling wire, twine, yarn and other rope-like material.

U.S. Pat. No. 2,357,065 issued to F. S. Zaica on Aug. 29, 1944;

U.S. Pat. RE. 25,477 issued to E. J. Crum on Nov. 12, 1963;

U.S. Pat. No. 2,849,195 issued to W. H. Richardson et al., on Aug. 26, 1958;

U.S. Pat. No. 2,929,179 issued to W. S. George on Mar. 22, 1960;

U.S. Pat. No. 2,936,509 issued to S. M. Martin on May 17, 1960;

U.S. Pat. No. 2,943,810 issued to F. R. Seavey on Jul. 5, 1960;

U.S. Pat. No. 2,944,755 issued to A. G. Foster on Jul. 12, 1960;

U.S. Pat. No. 2,957,640 issued to T. E. Lewis, Jr., on Oct. 25, 1960;

U.S. Pat. No. 3,054,570 issued to M. A. Nye on Sep. 18, 1962;

U.S. Pat. No. 3,088,690 issued to O. Haugwitz on May 7, 1963;

U.S. Pat. No. 3,113,745 issued to J. C. Bittman on Dec. 10, 1963;

U.S. Pat. No. 3,147,934 issued to J. Godderidge on Sep. 8, 1964;

U.S. Pat. No. 3,266,694 issued to D. D. Morris on Aug. 16, 1966;

U.S. Pat. No. 3,337,154 issued to F. J. Smith, Jr. et al., on Aug. 22, 1967;

U.S. Pat. No. 3,327,368 issued to C. J. Russo et al., on Jun. 27, 1967;

U.S. Pat. No. 3,423,043 issued to J. J. Kane et al., on Jan. 21, 1969;

U.S. Pat. No. 3,563,488 issued to G. Bollig on Feb. 16, 1971;

U.S. Pat. No. 3,737,112 issued to E. M. Tellerman et al., on Jun. 5, 1973;

U.S. Pat. No. 4,293,103 issued to K. Tsukamoto on Oct. 6, 1981;

U.S. Pat. No. 4,304,366 issued to H. Enneking et al., on Dec. 8, 1981;

US Design D263,371 issued to J. E. Allen, on Mar. 16, 1982;

U.S. Pat. No. 4,593,815 issued to D. A. Wright on Jun. 10, 1986;

US Design D324,644 issued to R. T. Jacobs on Mar. 17, 1992;

U.S. Pat. No. 7,370,823 issued to H. Lämmermann et al., on May 13, 2008.

While the rope and rope-like coiling machines of the prior art deserve undeniable merits, it is believed that there remains a market demand for a rope coiler that can be used to handle very long ropes in a stop and go manner while maintaining the circular array of the coiled rope.

SUMMARY OF THE PRESENT INVENTION

In the present invention, there is provided a method and a machine for coiling a long rope by segments. This method comprises the following steps:

attaching a first grab in a rope to the rim of a cylindrical mandrel;

rotating the mandrel about a vertical axis and forming a plurality of coils including a last coil, on the mandrel;

rotating a basket under the mandrel, at a same speed as the mandrel;

while rotating the mandrel and the basket, guiding the rope and forming the plurality of coils on the mandrel such that this plurality of coils are closely laid on top of one another and resting upon the first grab;

stopping a rotation of the mandrel and the basket;

releasing the first grab from the mandrel, causing the first grab and the plurality of coils to fall down from the mandrel and into the basket below the mandrel;

while releasing the first grab, holding a second or subsequent grab along a tail end of the last coil on the mandrel, and repeating the above steps of attaching; rotating; guiding and forming; stopping; releasing; causing; holding and repeating, with a second or subsequent grab, until the entire length of rope has been coiled in the basket.

Using this method, the coiling may be done in a stop and go manner. Work can be performed to the rope between the steps of stopping and releasing the first grab. Such work might include for example, detaching shellfish traps from the rope. Despite this stop and go coiling, the entire rope can be coiled in the basket without disruption to the symmetry of its coils.

In another aspect of the present invention, there is provided a rope coiling machine comprising:

a mandrel having a vertical axis of rotation; said mandrel having a lower rim and a notch in that lower rim, for retaining a grab in a rope;

a basket having a vertical axis of rotation, rotating co-axially with the mandrel, under the mandrel; and a rope guide assembly for guiding a coiling of a rope on the mandrel; this rope guide assembly comprising a vertical drive shaft having a lead screw, a driven sleeve movable along the lead screw; a half-nut assembly in that driven sleeve for selectively engaging the driven sleeve to the lead screw, such that the rope guide is movable in a consistent manner along the lead screw.

Because of the structure of this machine, a rope segment is coiled in a consistent manner on the mandrel and dropped in the basket without disruption to the symmetry of the coils.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

The coiling of rope according to the preferred method of the present invention and the machine for carrying out this method are described herein below with reference to the attached drawings, in which.

DETAILED DESCRIPTION OF THE PREFERRED EMBODIMENT

Figure 1:
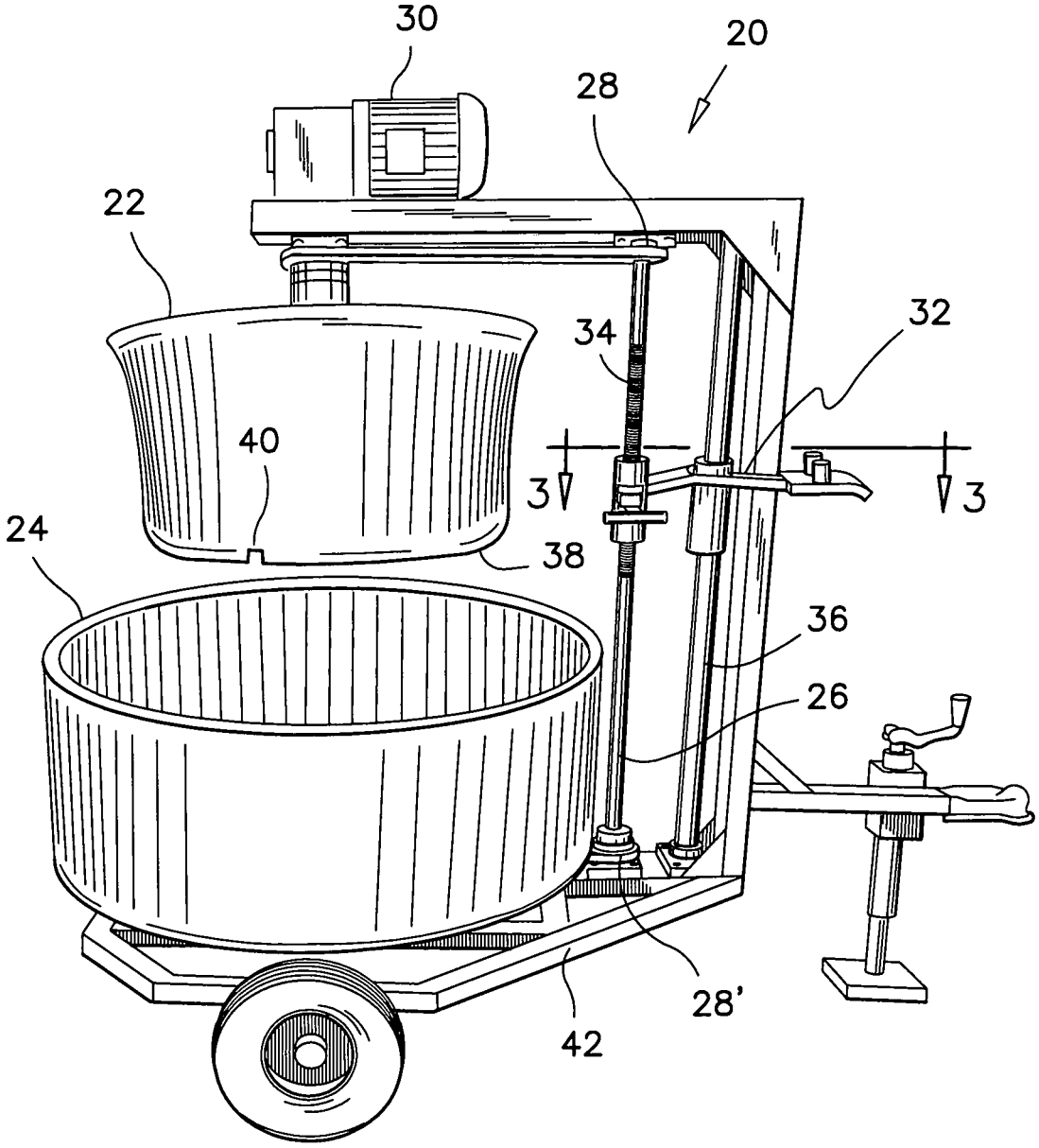
FIG. 1 is a partial perspective view of a machine used for carrying the method of sequentially coiling ropes by segments.
Figure 2:
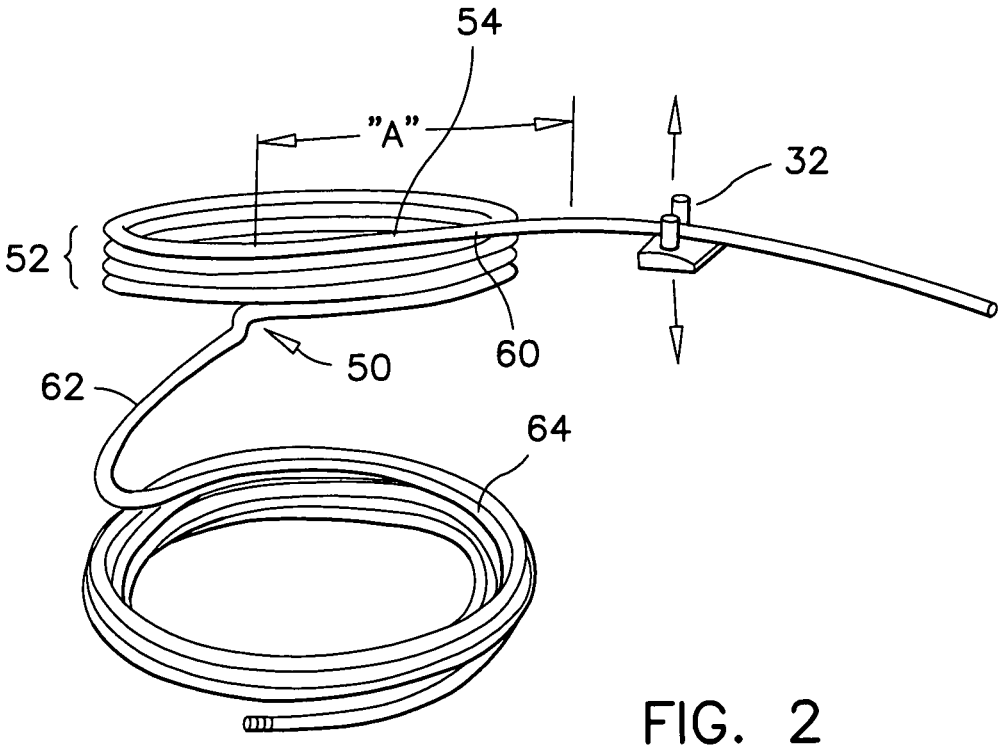
FIG. 2 is an illustration of a rope being coiled according to the preferred method of the present invention.

Referring to FIGS. 1 and 2, the machine 20 that is used for carrying out the method according to the preferred invention comprises a driven mandrel 22 and a driven basket 24. Both the mandrel 22 and the basket 24 rotate co-axially in unison for being entrained by a common drive shaft 26. As can be understood, the drive shaft 26 is connected by belts and sheaves 28, 28' to both the axle of the mandrel 22 and the axle (not shown) of the basket 24. A motor and gearbox 30 are connected to the axle of the mandrel 22 and drive both the mandrel 22 and the drive shaft 26 by way of the upper set of V-belt and sheave 28. A lower set of sheave and V-belt 28' drives the basket 24.

A rope guide assembly 32 is movable up and down along the drive shaft 26, on a lead screw 34 portion of the drive shaft 26. The rope guide assembly 32 is selectively engaged to the lead screw 34, as will be explained later. The rope guide assembly 32 is also guided along a guide post 36.

The mandrel 22 has a vertical axis of rotation and downward tapered shape. The lower rim 38 of the mandrel 22 has a notch 40 therein for retaining a grab 50 in a rope. In use, the grab 50 in the rope is inserted in the notch 40 and the mandrel 22 is rotated. In use, the rope guide assembly 32 moves upward, supporting the incoming portion of rope, and guiding the rope onto the mandrel 22 to form tight coils on the mandrel 22. The rope guide assembly 32 moves upward along the lead screw 34 as the mandrel 22 rotates to ensure that the coils are tightly formed and tightly laid one above the other on the mandrel 22.

When the rope is wound to the top of the mandrel 22 or as desired, the motor is stopped and the bottom coil of rope with the first grab 50 are slid off the notch 40, letting all the coils 52 on the mandrel 22 to fall down into the basket 24.

It will be appreciated that the number of coils formed on the mandrel 22 in one sequence represents, for examples, the length of rope between two lobster cages, between two snow crab cages, or between two mussel culture ropes. Coiling is interrupted to work the rope; to detach cages or fishing equipment from the rope, before coiling is resumed.

Simultaneously with releasing a first grab 50 from the notch 40 and sliding off the coils 52 from the mandrel 22 into the basket 24, a second grab 60 along a tail end "A" of the last coil 54 on the mandrel 22 rope is inserted in the notch 40, and another segment of rope is wound onto the mandrel 22. This sequence is repeated until the entire length of the rope has been coiled.

The machine 20 illustrated herein is mounted on a trailer frame 42. However, this machine can be fixed to the deck of a boat or mounted on a skid or a dolly which can be moved in and out of storage when needed.

Referring specifically to FIG. 2, the method for sequentially coiling a rope according to the preferred embodiment of the present invention will be explained.

This method is effected as follows:

attaching a first grab 50 in a rope to a notch 40 on the lower rim of a cylindrical mandrel 22;

rotating the mandrel 22 about a vertical axis and forming a plurality of coils 52 including a last coil 54, on the mandrel 22;

rotating a basket 24 under the mandrel 22, at the same speed as the mandrel 22 co-axially with the mandrel 22;

while rotating the mandrel 22 and the basket 24, guiding the rope and forming the plurality of coils 52 on the mandrel 22 such that this plurality of coils 52 are closely laid on top of one another and resting upon the first grab 50;

stopping a rotation of the mandrel 22 and the basket 24;

releasing the first grab 50 from the mandrel 22, causing the first grab 50 and the plurality of coils 52 to fall down from the mandrel 22 and into the basket 24;

while releasing the first grab 50, holding a second or subsequent grab 60 along a tail end "A" of the last coil 54 on the mandrel 22, and repeating the above steps of attaching; rotating; guiding and forming; stopping; releasing; causing; holding and repeating, with the second or subsequent grab 60, until the entire length of the rope has been coiled in the basket.

Because the tail end 62 of the last coil 64 that was dropped in the basket 24 has already been wound about the mandrel 22 in a previous segment, this tail end 62 has the exact arc length required to precisely overlap the previous coil 64.

Similarly, the tail end "A" of the coil 54 just formed has the exact arc length required to thread over and precisely overlap the last coil falling in the basket 24. Therefore, the exact position of the second grab 60 along the tail end "A" is not critical.

When the second grab 60 is selected in the tail end region "A" of the top coil 54, the entire rope is being coiled in the basket 24 without disruption to the symmetry of its coils. In a preferred embodiment, the mandrel 22 has dimensions to accept thereon about 150 feet of rope at the time.

While the first grab 50 is usually close to the leading end of a rope, the second and subsequent grabs 60 are at intermediate regions between the coiling segments or intervals of the rope. A coiled rope can be taken from the basket and laid on a deck. With a bit of practice in selecting the location of the second and subsequent grabs 60, within the tail end "A", the rope coiled by this method has a same appearance as one coiled by hand by an experienced sailor.

Figure 3:
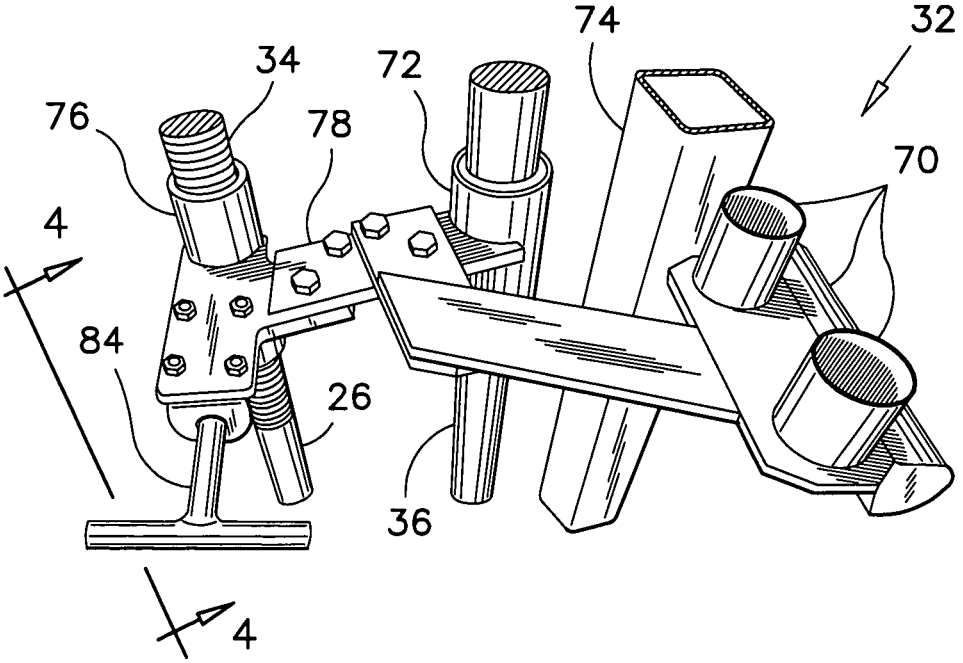
FIG. 3 is a partial perspective cross-section view of the rope guide mechanism as seen substantially along line 3-3 in FIG. 1.
Figure 4:
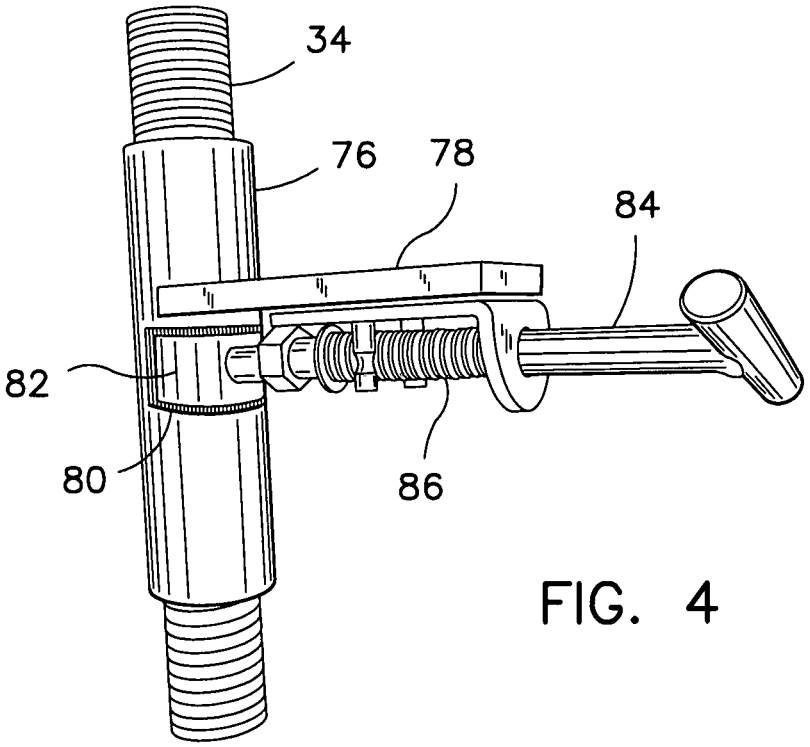
FIG. 4 is a partial perspective side view of the rope guide indexing mechanism as seen substantially along line 4-4 in FIG. 3.

Referring now to FIGS. 3 and 4, the rope guide assembly 32 will be described. The rope guide assembly 32 has a rope guide 70 which is made of spaced apart vertical short cylinders to guide a rope horizontally, and a curved nosing bar for supporting a rope vertically. The rope guide 70 is guided in a vertical movement by a training sleeve 72 mounted to the guide post 36. For reference purposes, the guide post 36 is parallel to and held firm relative to the frame member 74 of the machine 20.

The training sleeve 72 is connected to a driven sleeve 76 by a joiner member 78. The driven sleeve 76 is selectively engaged to the lead screw 34 of the drive shaft 26.

Referring particularly to FIG. 4, the driven sleeve 76 has an opening 80 through the wall thereof, exposing the threads of the lead screw 34. A half-nut 82 is movable through that opening for selectively engaging the threads of the lead screw 34. A stem and a handle assembly 84 is connected to the half-nut 82. A spring 86 is mounted to this stem and handle assembly 84 for urging the half-nut 82 into an engagement with the lead screw 34.

In use, the handle and stem assembly 84 is pulled away from the driven sleeve 76 to release the engagement of the half-nut 82 from the lead screw 34 to move the driven sleeve 76 from the top of the lead screw 34 to the bottom of the lead screw 34 for example, to start a new coil on the mandrel 22. It will be appreciated that an engagement of the half-nut 82 to the lead screw 34 drives the driven sleeve 76 and the rope guide assembly 32 upward at the right pitch speed of about one thickness of the rope per turn of the mandrel 22, for forming a tight coil of rope on the mandrel 22.

The invention claimed is:

1. A machine for sequentially coiling a rope by segments, comprising:

a cylindrical mandrel having a first vertical axis of rotation; a lower rim and a notch in said lower rim, for retaining a grab in a rope;

a cylindrical basket having a second vertical axis of rotation extending co-axially with said first axis of rotation, under said mandrel; and a rope guide assembly for guiding a coiling of a rope on said mandrel; said rope guide assembly comprising a vertical drive shaft having a lead screw, a driven sleeve movable along said lead screw; a half-nut assembly in said driven sleeve for selectively engaging said lead screw, such that said rope guide is movable in a consistent manner along said lead screw.

2. The machine as claimed in claim 1, wherein said lead screw extends parallel with said axis of rotation of said mandrel.

3. The machine as claimed in claim 1, further comprising a drive shaft connected with said first vertical axis of rotation of said mandrel and said second vertical axis of rotation of said basket.

4. The machine as claimed in claim 3, wherein said lead screw is a portion of said drive shaft.

5. The machine as claimed in claim 4, further including a handle for selectively engaging said half-nut to said lead screw by hand.

6. The machine as claimed in claim 5, further including a frame, and wherein said rope guide assembly is guided on a guide post mounted between said drive shaft and a framing member of said frame.

7. The machine as claimed in claim 6, wherein said guide post extends parallel with said drive shaft.

8. The machine as claimed in claim 6, wherein said frame is a portion of a trailer.

9. The machine as claimed in claim 7, wherein said rope guide comprises a training sleeve sliding on said guide post.

10. The machine as claimed in claim 1, wherein said half-nut is urged against said lead screw by a spring.

* * * * *